US008893700B2

(12) United States Patent
Kozlik et al.

(10) Patent No.: US 8,893,700 B2
(45) Date of Patent: Nov. 25, 2014

(54) ARCHERY BOW STABILIZER HAVING ASYMMETRICAL DAMPENERS

(75) Inventors: Christopher A. Kozlik, Schaumburg, IL (US); Robert S. Mizek, Downers Grove, IL (US)

(73) Assignee: New Archery Products Corporation, Forest Park, IL (US)

( * ) Notice: Subject to any disclaimer, the term of this patent is extended or adjusted under 35 U.S.C. 154(b) by 286 days.

(21) Appl. No.: 13/294,673

(22) Filed: Nov. 11, 2011

(65) Prior Publication Data

US 2013/0118468 A1 May 16, 2013

(51) Int. Cl.
*F41B 5/20* (2006.01)
*F41B 5/14* (2006.01)

(52) U.S. Cl.
CPC ..... *F41B 5/1426* (2013.01)
USPC ..... 124/89; 124/23.1; 124/25.6; 124/86; 124/88

(58) Field of Classification Search
CPC ..... F41B 5/1426
USPC ..... 124/23.1, 25.6, 86, 88, 89
See application file for complete search history.

(56) References Cited

U.S. PATENT DOCUMENTS 3,342,172 A 9/1967 Sanders
3,412,725 A * 11/1968 Hoyt, Jr. ..... 124/84
3,502,062 A 3/1970 Shurts
3,628,520 A 12/1971 Izuta
3,752,142 A * 8/1973 Morita et al. ..... 124/24.1
4,054,121 A * 10/1977 Hoyt, Jr. ..... 124/89
5,090,396 A 2/1992 Bickel et al.
5,385,136 A * 1/1995 Thomas ..... 124/89
5,460,156 A 10/1995 Sappington
5,535,731 A * 7/1996 Webster ..... 124/89
5,611,325 A 3/1997 Kudlacek
5,630,407 A * 5/1997 Gasser ..... 124/89
D389,551 S 1/1998 Fitzgerald, Jr.
5,904,134 A * 5/1999 Denbow ..... 124/89
5,992,403 A 11/1999 Slates
6,186,135 B1 2/2001 Harwath et al.
D442,251 S * 5/2001 Fitzgerald, Jr. ..... D22/107
D446,278 S 8/2001 Fitzgerald, Jr.
6,382,201 B1 * 5/2002 McPherson et al. ..... 124/89
6,431,163 B1 8/2002 Chipman
6,494,196 B2 12/2002 Harwath et al.
6,526,957 B1 * 3/2003 Leven ..... 124/89
6,712,059 B2 * 3/2004 Donovan ..... 124/89
6,718,964 B1 * 4/2004 Graf ..... 124/89
6,817,352 B1 11/2004 Saunders
6,910,472 B2 * 6/2005 Mizek et al. ..... 124/89
7,703,449 B2 * 4/2010 Wright ..... 124/89
7,793,645 B2 * 9/2010 Walk et al. ..... 124/89
7,954,481 B2 * 6/2011 Barnard ..... 124/88
7,958,881 B2 * 6/2011 Silverson ..... 124/86
8,166,963 B2 * 5/2012 Leven ..... 124/89
8,225,778 B2 * 7/2012 Walk et al. ..... 124/89
8,347,870 B1 * 1/2013 Mahutga ..... 124/89
8,534,273 B2 * 9/2013 LoRocco et al. ..... 124/89

(Continued)

*Primary Examiner* — Gene Kim
*Assistant Examiner* — Alexander Niconovich
(74) *Attorney, Agent, or Firm* — Pauley Petersen & Erickson

(57) ABSTRACT

An archery bow stabilizer including a stabilizer body and a plurality of asymmetrical dampening extensions radially extending from the stabilizer body. The dampening extensions can be laterally offset with respect to the stabilizer body from an adjacent dampening extension and/or can include laterally extending protuberances that extend in an opposite direction from as adjacent dampening extension.

20 Claims, 3 Drawing Sheets

(56) References Cited

U.S. PATENT DOCUMENTS

| | | | | |
|---|---|---|---|---|
| D692,976 | S * | 11/2013 | Sims | D22/107 |
| 8,573,193 | B2 * | 11/2013 | Khoshnood | 124/89 |
| 8,590,522 | B2 * | 11/2013 | Khoshnood et al. | 124/89 |
| 8,656,899 | B2 * | 2/2014 | Bednar et al. | 124/25 |
| 2003/0121510 | A1 * | 7/2003 | Mizek et al. | 124/89 |
| 2003/0226556 | A1 | 12/2003 | Leven | |
| 2004/0178550 | A1 * | 9/2004 | Donovan | 267/136 |
| 2005/0011509 | A1 | 1/2005 | Sandberg | |
| 2006/0180135 | A1 * | 8/2006 | Andrews | 124/89 |
| 2006/0278207 | A1 | 12/2006 | Goade | |
| 2007/0079821 | A1 * | 4/2007 | Walk et al. | 124/86 |
| 2009/0032005 | A1 * | 2/2009 | Wright | 124/89 |
| 2010/0031946 | A1 * | 2/2010 | LoRocco | 124/89 |
| 2010/0095943 | A1 | 4/2010 | Cooper | |
| 2010/0242940 | A1 * | 9/2010 | Leven | 124/89 |
| 2010/0319670 | A1 * | 12/2010 | Sims et al. | 124/89 |
| 2010/0326415 | A1 * | 12/2010 | Walk et al. | 124/89 |
| 2012/0260902 | A1 * | 10/2012 | Felt et al. | 124/25.6 |
| 2013/0047972 | A1 * | 2/2013 | Walk et al. | 124/25.6 |
| 2013/0055998 | A1 * | 3/2013 | LoRocco et al. | 124/89 |

* cited by examiner

ARCHERY BOW STABILIZER HAVING ASYMMETRICAL DAMPENERS

BACKGROUND OF THE INVENTION

1. Field of the Invention

This invention relates to a shock absorbing bow stabilizer that is mounted to an archery bow, for one reason to reduce recoil, shock, vibration and noise when an arrow is shot from the archery bow. More specifically, this invention relates to a shock absorbing bow stabilizer having a plurality of spaced apart vibration dampening elements each including radially extending asymmetrical dampening extensions.

2. Description of Related Art

Various bow stabilizers and vibration dampeners have been developed to absorb shock when an arrow is shot from an archery bow. Conventional bow stabilizers generally have a hollow cylinder filled either with a viscous fluid or solid particles to attenuate vibration when an archery arrow is released from an archery bow. For example, one conventional bow stabilizer has a hollow body that defines a sealed chamber that is partially filled with granular solids. The bow stabilizer is mounted to the archery bow and has a counterweight that is fixedly adjustable along a longitudinal axis of the elongated hollow body. The hollow body has two end plugs, each end plug having a connecting portion connected to a plug portion. The connecting portion has a peripheral knurled surface to secure the end plug to the hollow body of the bow stabilizer. The end plugs are typically press fitted to the hollow body to contain the granular solids within the hollow body.

After the archery arrow is released from the archery bow, the archery bow recoils in a cyclic fashion. During a first recoil, the granular solid particles move in a direction towards a first end portion of the chamber and collide with an interior surface of the end plug which seals the opening at the first end portion. During an opposite second recoil, the granular solid particles move in a direction toward a second end portion of the chamber and collide with an interior surface of the end plug which seals the opening at the proximal end portion. This cycle of recoils continues for several milliseconds before the archery bow comes to rest. Because the interior surfaces of the end plugs can be generally flat, a relatively large number of particles collide with the interior surfaces during the recoil cycle. The impact of the particles with the interior surfaces of the bow stabilizer contributes to a recoil vibration having an increased amplitude.

There is a continuing need for improved vibration dampening archery stabilizers.

SUMMARY OF THE INVENTION

In some embodiments of the stabilizer according to this invention, the stabilizer includes a stabilizer body and a plurality of asymmetrical dampening extensions radially extending from the stabilizer body. The multiple asymmetrical dampening extensions can be disposed around the stabilizer body in alternating offset positions and/or include opposite facing asymmetrical features. The dampening extensions are desirably formed of a suitable vibration absorption material, such as a flexible rubber or elastomeric material that allows the dampening extensions, and particularly any asymmetrical protuberances to flex and mitigate the bow recoil, shock, vibration and/or noise.

In some embodiments of this invention, an archery bow stabilizer includes a stabilizer body and at least a first vibration dampening element and a second dampening element.

Each of the first and second vibration dampening elements includes a dampening body and a plurality of dampening extensions radially extending from the dampening body and including a laterally extending protuberance. In one embodiment, the stabilizer includes a third, and preferably more than three, vibration dampening element. The multiple vibration dampening elements can be placed in alternating offset positions and/or include opposite facing laterally extending protuberances.

In one embodiment of this invention, an archery bow stabilizer includes a stabilizer body with an attachment end with a bow attachment element and a plurality of stabilizer bars extending from the attachment end. A first vibration dampening element includes a first dampening body, a plurality of first element openings in the first dampening body each correspondingly sized to and receiving one of the plurality of stabilizer bars, and a first plurality of asymmetrical dampening extensions radially extending from the first dampening body and each including a first laterally extending protuberance. A second vibration dampening element is longitudinally spaced apart from the first vibration dampening element and includes a second dampening body, a plurality of second element openings in the first dampening body each correspondingly sized to and receiving one of the plurality of stabilizer bars, and a second plurality of asymmetrical dampening extensions radially extending from the second dampening body and each including a second laterally extending protuberance. Each of the first plurality of dampening extensions and first laterally extending protuberance is offset laterally about the stabilizer body from and/or extends in a direction relative to the stabilizer body that is opposite from a direction of, each second plurality of dampening extensions and second laterally extending protuberance.

BRIEF DESCRIPTION OF THE DRAWINGS

This invention is explained in greater detail below in view of exemplary embodiments shown in the drawings.

DESCRIPTION OF PREFERRED EMBODIMENTS

Figure 1:
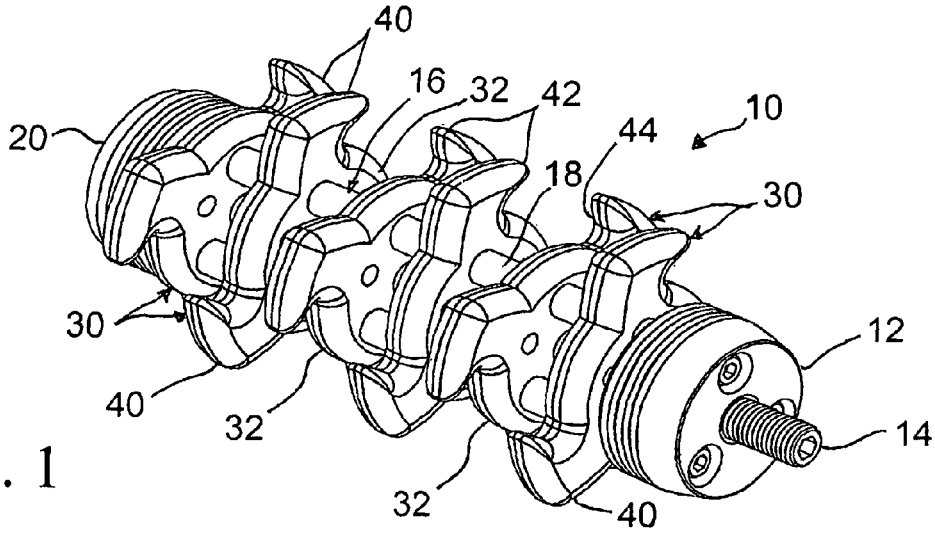
FIG. 1 is a perspective view of a stabilizer according to one embodiment of this invention.
Figure 2:
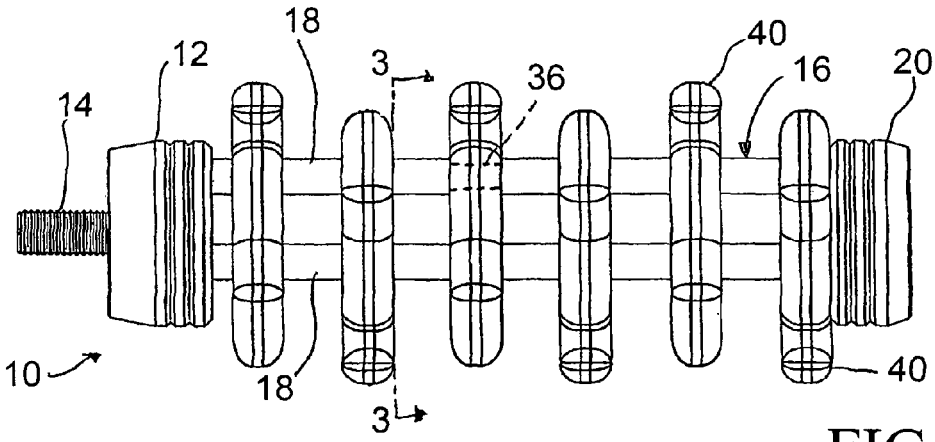
FIG. 2 is a side view of the stabilizer of FIG. 1.
Figure 3:
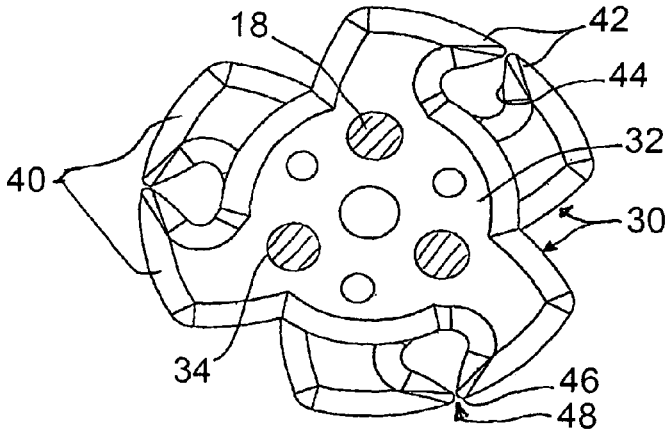
FIG. 3 is a sectional view along line 3-3 in FIG. 2.

FIGS. 1-3 show an embodiment of a stabilizer 10 for use in balancing and/or reducing recoil, shock, vibration and/or noise during shooting of an archery bow. The stabilizer 10 includes an attachment end 12 with a bow attachment element 14. In the embodiment of FIGS. 1-3, the bow attachment element is a threaded male element coordinating with a female threaded element on the bow. Various and alternative attachment elements can be used depending on need and the particular archery bow.

The stabilizer 10 includes a longitudinally extending stabilizer body 16. The stabilizer body 16 can be a single body element or composed of more than one body element, such as shown in FIGS. 1-3. In some embodiments of this invention, the stabilizer body 16 includes at least one, and preferably more than one longitudinal extending stabilizer bar 18. In the illustrated embodiment of FIGS. 1-3, the stabilizer body 16 includes three stabilizer bars 18 extending between the attachment end 14 and an end cap 20. The use of more than one stabilizer bar 18 can increase strength and/or be particularly useful in limiting rotation of vibration dampening elements 30 mounted thereon. Various and alternative sizes, shapes, lengths, and configurations are available for the stabilizer body and/or bars according to this invention, depending on need. For example, one or more non-cylindrical stabilizer bars, such as having a square, rectangle, oval, or triangle cross-sectional shape, can also be used, and would limit rotation of vibration dampening elements.

The stabilizer 10 includes a plurality of vibration dampening elements 30 disposed around the stabilizer body 16. In one embodiment of this invention, the vibration dampening elements extend around a circumferential periphery of at least a portion or segment of the stabilizer body. As shown in FIGS. 1-3, each of the six illustrated vibration dampening elements 30 includes a dampening body 32 that extends around the stabilizer bars 18. Each dampening body 32 is round and includes an element opening 34 for each stabilizer bar 18. The element openings 34 are desirably correspondingly sized to the corresponding stabilizer bar 18 to provide a secure fit. In one embodiment of this invention, the stabilizer bars 18 include reduced diameter seats 36 corresponding to the diameter of the element openings 34 to provide a placement position for each of the vibration dampening elements 30.

In the embodiment shown in FIGS. 1-3, the vibration dampening elements 30 are spaced apart along a longitudinal axis of the stabilizer body 16. Each vibration dampening element 30 is spaced apart from, and not in direct contact with, any adjacent vibration dampening elements 30. The length of the spacing, if any, can vary depending on need and the length and/or configuration of the stabilizer body. Some or all of the spaces between the vibration dampening elements 30 can be equal or different, and the first and last vibration dampening elements 30 can be in contact with or spaced apart from the attachment end and the end cap 20, respectively.

In one embodiment of this invention, one or more of the vibration dampening elements is or includes at least one, and desirably a plurality, of dampening extensions radially extending outward from the stabilizer body. As shown in FIGS. 1-3, three dampening extensions 40 extend radially outward from each dampening body 32. As illustrated in FIGS. 1-3, the radially extending dampening extensions 40 of each vibration dampening element 30 are positioned around the circumference of the stabilizer body 16, and offset laterally, with respect to the stabilizer body 16, from dampening extensions 40 of directly adjacent vibration dampening element(s) 30. As shown in FIG. 1, the alternating vibration dampening elements 30 include two element opening 34 configurations, which provide the offset positioning of the dampening extensions 40. Various and alternative sizes, shapes, configurations, and offset positions are available for the dampening extensions according to this invention, depending on need and/or the number of desired radially extending dampening extensions.

In one embodiment of this invention, the dampening extensions are asymmetrical in shape, such as having more material mass on one side of the dampening extension. In the embodiment of FIGS. 1-3, at least a plurality, and desirably all, of the dampening extensions 40 are asymmetrical and include a peripherally or laterally extending protuberance 42. The laterally extending protuberances 42 desirably extend from only one side of the dampening extensions 40, to form a bent or hook-like tip of the dampening extensions 40. As best shown in FIG. 3, the protuberances 42 extend in a direction generally parallel to a tangent of the stabilizer body 16, with an underside 44 of the protuberances 42 desirably spaced apart from the dampening body 32 and/or the stabilizer body 16.

In one embodiment of this invention, the protuberances 42 of the alternating offset dampening elements 40 are configured in opposing directions. Referring to FIGS. 1-3, a first plurality of laterally extending protuberances 42 extend in a first direction relative to the stabilizer body 16 that is opposite from a second direction of a second plurality of the laterally extending protuberance 42. Rows of the first plurality of protuberances 42 are aligned along the longitudinal axis of the stabilizer 10, and rows of the second plurality of protuberances 42 are also aligned along the longitudinal axis of the stabilizer 10, with each row of the second plurality of protuberances 42 offset from a corresponding row of the first plurality of protuberances 42. As seen in FIG. 3, tips 46 of the corresponding rows of protuberances 42 are each oriented toward and optionally abutting a common imaginary line 48 parallel to a longitudinal axis of the stabilizer body 16.

Figure 5:
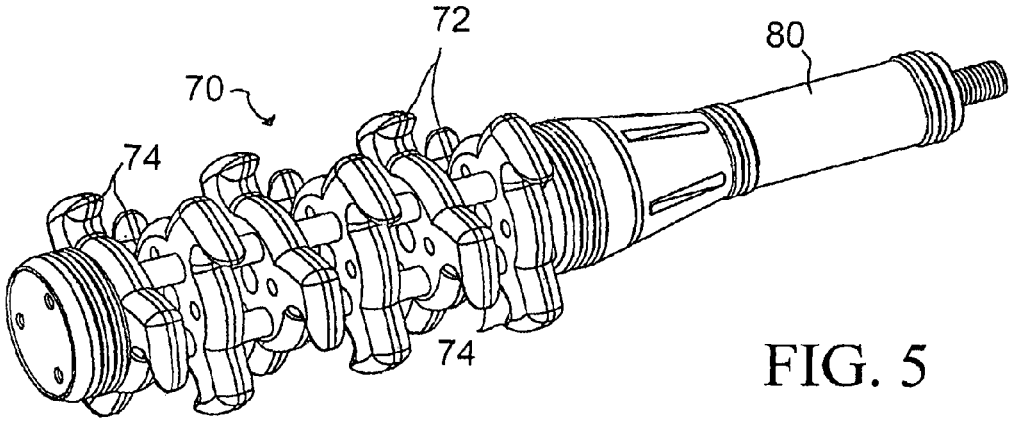
FIG. 5 is a perspective view of a stabilizer according to yet another embodiment of this invention.
Figure 6:
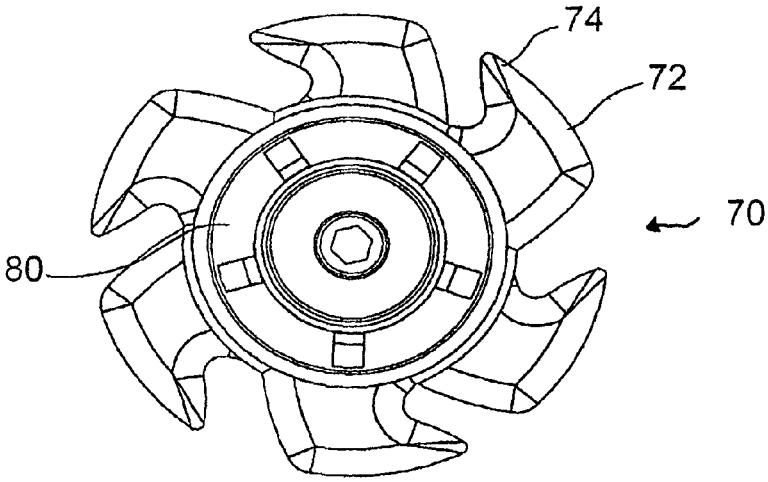
FIG. 6 is an end view of the stabilizer of FIG. 5.

The vibration dampening elements of this invention, including the dampening body, dampening extensions, and laterally extending protuberances, are desirably made of a flexible material, such as a rubber or an elastomeric material. The flex of the vibration dampening elements allows, for example, for absorption of vibrations from the firing of an archery bow. In particular, it is believed that the ability of the protuberances to flex between a direction toward the stabilizer body and a direction away from the stabilizer body is particularly beneficial to reducing bow vibrations. Various and alternative configurations of the laterally extending protuberances of this invention are available for vibration dampening. For example, the dampening elements need not be offset, and/or the protuberances can all be orientated in the same direction, as shown in FIGS. 5 and 6. However, the offset and direction alternating configuration of the protuberances shown in FIGS. 1-3 has been found to be particularly beneficial in reducing vibrations.

Figure 4:
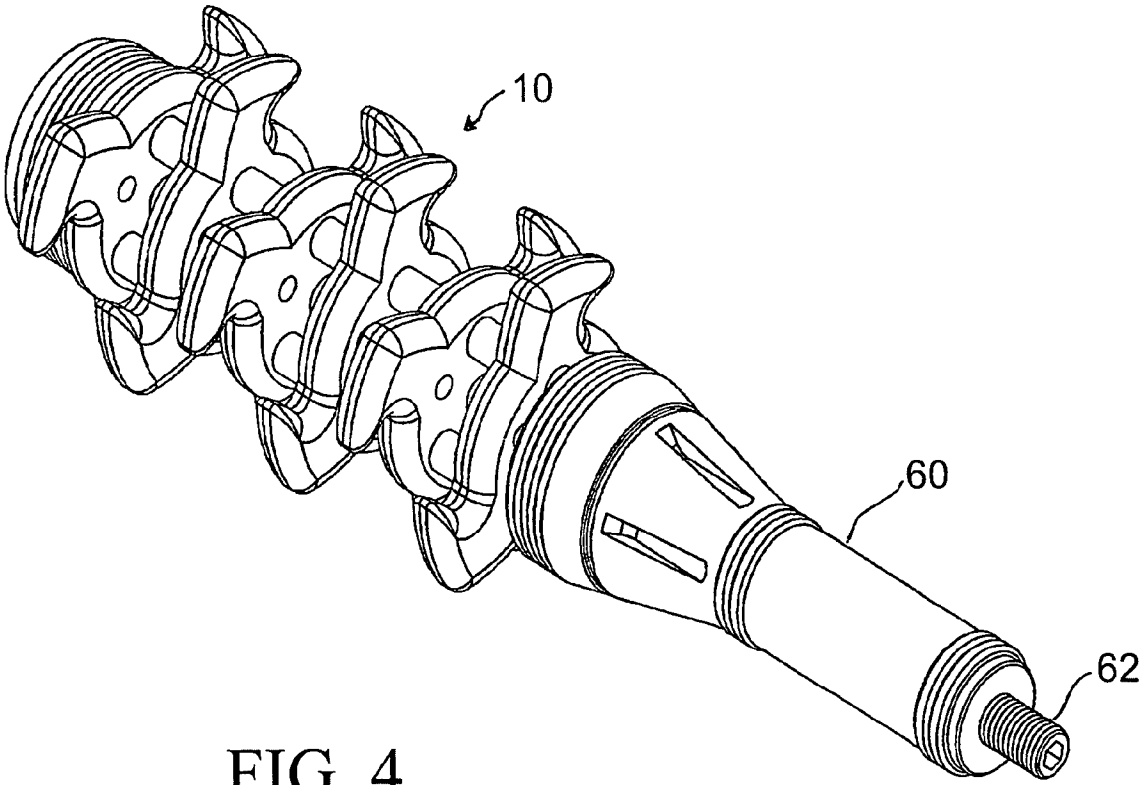
FIG. 4 is a perspective view of a stabilizer according to another embodiment of this invention.

FIG. 4 illustrates an alternative embodiment of the stabilizer according to this invention. In FIG. 4, a stabilizer 10, similar or identical to the stabilizer shown in FIG. 1, is coupled with a removable extension bar 60. The extension bar is an optional accessory to increase the length and/or weight of the stabilizer 10, thereby increasing the bow balancing ability of the stabilizer 10. The attachment element (not shown in FIG. 4) of the stabilizer 10 can thread into a corresponding female element of the extension bar 60, and the extension rod 60 can attach to the bow using threaded bar attachment element 62. In one embodiment the extension, the extension bar 60 can be sized to add from about 2 to about 4 inches to, for example, a stabilizer 10 sized from about 4 inches to about 6 inches.

FIGS. 5 and 6 illustrate another embodiment of the stabilizer according to this invention. In FIG. 5, a stabilizer 70 is coupled with a removable extension bar 80, such as discussed above. The stabilizer 70 includes asymmetrical dampening extensions 72 with laterally extending protuberance 74. The laterally extending protuberances 74 extend from only one side of the dampening extensions 72. In the embodiment of this invention shown in FIGS. 5 and 6, the protuberances 74 of the alternating offset dampening elements 72 are configured in the same direction.

While in the foregoing specification this invention has been described in relation to certain preferred embodiments, and many details are set forth for purpose of illustration, it will be apparent to those skilled in the art that this invention is susceptible to additional embodiments and that certain of the details described in this specification and in the claims can be varied considerably without departing from the basic principles of this invention.

What is claimed is:

1. An archery bow stabilizer, comprising:

a stabilizer body; and a plurality of asymmetrical dampening extensions radially extending from the stabilizer body, wherein each of the asymmetrical dampening extensions includes a laterally extending protuberance over and spaced apart from the stabilizer body and extending in a direction parallel to a tangent of the stabilizer body.

2. The stabilizer according to claim 1, wherein each asymmetrical dampening extensions is formed of a flexible material and flexes in direction toward the stabilizer body and away from the stabilizer body.

3. The stabilizer according to claim 1, further comprising a second plurality of asymmetrical dampening extensions offset laterally about the stabilizer body from the plurality of asymmetrical dampening extensions.

4. The stabilizer according to claim 1, further comprising a first plurality of laterally extending protuberances extending in a direction relative to the stabilizer body that is opposite from a direction of a second plurality of laterally extending protuberance.

5. The stabilizer according to claim 1, further comprising:

a first vibration dampening element mounted on the stabilizer body and including a first plurality of radially extending dampening extensions; and a second vibration dampening element mounted on the stabilizer body and including a second plurality of radially extending dampening extensions each longitudinally spaced apart from the first plurality of dampening extensions.

6. The stabilizer according to claim 5, wherein each of the first and second vibration dampening elements extends around a circumference of the stabilizer body.

7. The stabilizer according to claim 5, wherein the second plurality of radially extending dampening extensions are offset laterally from the first plurality of dampening extensions.

8. The stabilizer according to claim 7, wherein the first plurality of radially extending dampening extensions each includes a first laterally extending protuberance, the second plurality of radially extending dampening extensions each includes a second laterally extending protuberance, and each second laterally extending protuberance of the second plurality of radially extending dampening extensions extends in a direction relative to the stabilizer body that is opposite from a direction of the first laterally extending protuberance of the first plurality of radially extending dampening extensions.

9. An archery bow stabilizer, comprising:

a stabilizer body;

a first vibration dampening element including a first dampening body, and a first plurality of dampening extensions radially extending from the first dampening body and each including a first laterally extending protuberance that extends in a direction tangential to the stabilizer body;

a second vibration dampening element including a second dampening body, and a second plurality of dampening extensions radially extending from the second dampening body and each including a second laterally extending protuberance that extends in a direction tangential to the stabilizer body.

10. The stabilizer according to claim 9, wherein each laterally extending protuberance is spaced apart from the stabilizer body and extends in a direction parallel to a tangent of the stabilizer body.

11. The stabilizer according to claim 9, wherein each first laterally extending protuberance is offset laterally about the stabilizer body from at least one second laterally extending protuberance.

12. The stabilizer according to claim 9, wherein each first laterally extending protuberance extends in a direction relative to the stabilizer body that is opposite from a direction of each second laterally extending protuberance.

13. The stabilizer according to claim 9, wherein each first laterally extending protuberance extends in a direction relative to the stabilizer body that is the same as a direction of each second laterally extending protuberance.

14. The stabilizer according to claim 9, wherein the first vibration dampening element is longitudinally spaced apart from the second vibration dampening element on the stabilizer body.

15. The stabilizer according to claim 9, wherein the stabilizer body comprises an attachment end with a bow attachment element and a plurality of stabilizer bars extending from the attachment end, wherein each of the first dampening body and the second dampening body is disposed around the plurality of stabilizer bars.

16. The stabilizer according to claim 9, further comprising a third vibration dampening element including a third dampening body, and a third plurality of dampening extensions radially extending from the third dampening body and each including a third laterally extending protuberance, the third vibration dampening element longitudinally spaced apart from the second vibration dampening element on a side opposite the first vibration dampening element.

17. The stabilizer according to claim 16, wherein the third vibration dampening element is aligned with the first vibration dampening element.

18. The stabilizer according to claim 16, wherein each first laterally extending protuberance and each third laterally extending protuberance extend in a direction relative to the stabilizer body that is opposite from a direction of each second laterally extending protuberance.

19. The stabilizer according to claim 18, wherein a tip of one first laterally extending protuberance, a tip of one third laterally extending protuberance, and a tip of one second laterally extending protuberance are each oriented toward and abutting a common imaginary line parallel to a longitudinal axis of the stabilizer body.

20. An archery bow stabilizer, comprising:

a stabilizer body including an attachment end with a bow attachment element and a plurality of stabilizer bars extending from the attachment end;

a first vibration dampening element including a first dampening body, a plurality of first element openings in the first dampening body each correspondingly sized to and receiving one of the plurality of stabilizer bars, and a first plurality of dampening extensions radially extending from the first dampening body and each including a first laterally extending protuberance; and a second vibration dampening element detached from and longitudinally spaced apart from the first vibration dampening element and including a second dampening body, a plurality of second element openings in the first dampening body each correspondingly sized to and receiving one of the plurality of stabilizer bars, and a second plurality of dampening extensions radially extending from the second dampening body and each including a second laterally extending protuberance;

wherein each first laterally extending protuberance of the first plurality of dampening extensions is offset laterally about the stabilizer body from, and extends in a direction relative to the stabilizer body that is opposite from a direction of, each second laterally extending protuberance of the second plurality of dampening extensions.

* * * * *